United States Patent [19]

Kanaya

[11] Patent Number: 4,755,797

[45] Date of Patent: Jul. 5, 1988

[54] FIRE ALARM APPARATUS

[75] Inventor: Fumio Kanaya, Tokyo, Japan

[73] Assignee: Nittan Co., Ltd., Tokyo, Japan

[21] Appl. No.: 60,676

[22] Filed: Jun. 11, 1987

[30] Foreign Application Priority Data

Aug. 14, 1986 [JP] Japan ..... 61-189513

[51] Int. Cl.[4] ..... G08B 21/00

[52] U.S. Cl. ..... 340/506

[58] Field of Search ..... 340/568, 506

[56] References Cited

U.S. PATENT DOCUMENTS 4,369,435 1/1983 Adachi et al. ..... 340/506

FOREIGN PATENT DOCUMENTS 52-151599 6/1976 Japan .

119934 7/1984 Japan ..... 340/568

*Primary Examiner*—Stewart J. Levy

*Assistant Examiner*—Joseph W. Roskos

*Attorney, Agent, or Firm*—Hill, Van Santen, Steadman & Simpson

[57] ABSTRACT

A fire alarm apparatus includes a fire receiver, a pair of transmission lines extending from the fire receiver, a series of nonpolar fire detectors connected to the transmission lines, and a terminating unit, connected to the end terminals of the transmission lines, the terminating unit having an impedance element including a polar element. Each fire detector includes polarity inverting circuitry which includes a limit switch, arranged at a socket portion of the detector, and having a switch lever which is actuated by the detector body engaging with the socket portion; and diodes for inverting the polarity of the pair of transmission lines in synchronism with actuation of the switch lever. The polarity of the transmission lines after a detector is inverted when a detector body is detached from that detector.

5 Claims, 2 Drawing Sheets

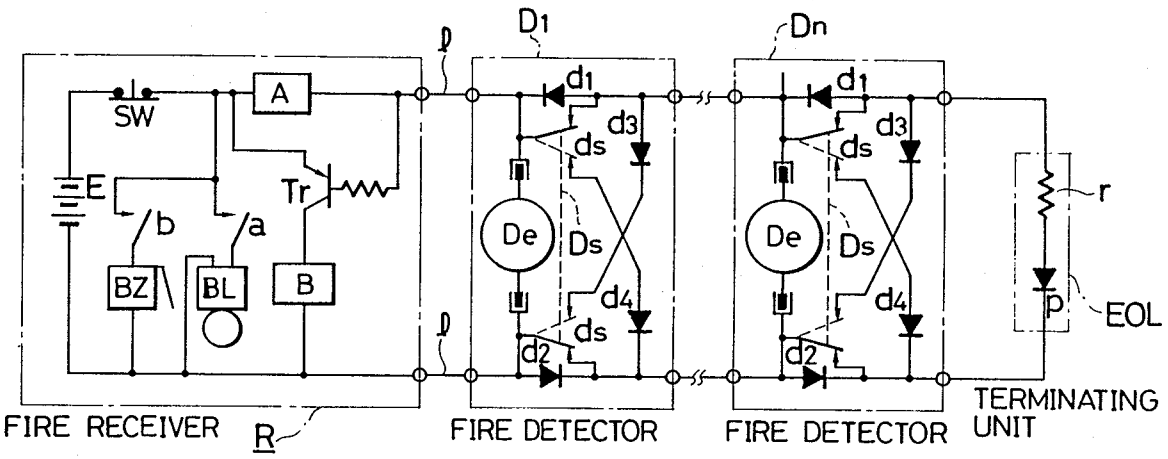
FIG. 1
Dn
D1
d1
d2
d3
d4
ds
Ds
De
FIRE DETECTOR
FIRE DETECTOR
r
p
EOL
TERMINATING UNIT
A
B
Tr
a
b
BL
BZ
SW
E
FIRE RECEIVER
R
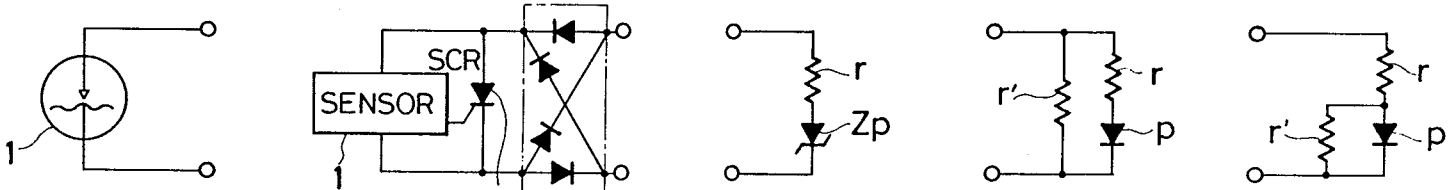
FIG.2A
FIG.2B
FIG.3A
FIG.3B
FIG.3C
1
SCR
SENSOR
2
3
r
Zp
r'
p

FIRE ALARM APPARATUS

BACKGROUND OF THE INVENTION

1. Field of the Invention

The present invention relates to a fire alarm apparatus and, more particularly, to a fire alarm apparatus which detects accidental detachment of a fire detector by, e.g., burglary, and generates an alarm.

2. Description of the Prior Art

A fire alarm apparatus which detects burglary or the like of a fire detector and generates an alarm is disclosed in Japanese Patent Disclosures (Kokai) Nos. 52-151599 and 56-21294.

In the former apparatus, a contact mechanism is provided to short-circuit transmission lines when a fire detector body is detached from a socket, and in the latter apparatus, transmission lines are temporarily or periodically cut when a detector body is detached.

Conventional fire alarm apparatuses as described above pose several problems. After a fire detector is detached, the function of another detector connected to the same line is stopped. Alarm errors are generated by noise and the like because of the complex arrangement. A burglary alarm cannot be discriminated from a fire alarm or a disconnection alarm.

SUMMARY OF THE INVENTION

It is an object of the present invention to provide a simple fire alarm apparatus wherein detachment of a fire detector can be reliably detected.

It is another object of the present invention to provide a fire alarm apparatus wherein signals representing an operation of a detector, disconnection of a transmission line, and detachment of a detector body can be easily discriminated to generate alarms.

In order to achieve the above objects, there is provided a fire alarm apparatus having a fire receiver, a pair of transmission lines extending from the fire receiver, a plurality of nonpolar fire detectors connected to the transmission lines each detector received in a detector mount and a terminating unit connected to the terminals of the transmission lines. The terminating unit consists of an impedance element including a polar element. Each fire detector includes polarity inverting means for inverting the polarity of the transmission lines after the detector when a sensing element of a detector is detached from that detector's mount.

DESCRIPTION OF THE DRAWINGS

FIG. 1 is a circuit diagram of an embodiment of a fire alarm apparatus of the present invention.

FIGS. 2A and 2B are circuit diagrams of a nonpolar fire detector connected to a fire alarm apparatus of the present invention.

FIGS. 3A, 3B, and 3C are examples of circuit diagrams of a terminating unit.

DESCRIPTION OF THE PREFERRED EMBODIMENTS

The present invention will now be described in detail with reference to embodiments in conjunction with the accompanying drawings.

FIG. 1 is a circuit diagram of a fire alarm apparatus of the present invention. The apparatus includes a fire receiver R, fire detectors $D_1$ to $D_n$ and a terminating unit EOL. The fire receiver R includes a zone relay A, a transistor Tr, having a control path connected to both sides of the relay A, and which is turned on/off in accordance with a potential between the sides, a relay B which is controlled by the transistor Tr, an alarm bell BL and an alarm buzzer BZ connected to a power source E through normally open contacts a and b of the relays A and B, and a reset switch SW.

Each fire detector D, connected to a pair of transmission lines l, includes a detector body De (which includes the sensing portion or elements of the detector), a limit switch Ds provided in a socket or mount portion, and diodes $d_1$ to $d_4$ for inverting the polarity of the transmission lines l after the detector D by a contact of the limit switch Ds.

The terminating unit EOL, connected to terminals of the transission lines l, includes a series circuit of an impedance element r and a polar element P such as a diode.

An example of a circuit configuration of the detector body De is a circuit in which a contact is closed at a predetermined temperature as shown in FIG. 2A. Another example is a so-called smoke or gas detector, or the like, having a sensor 1 for detecting, e.g., smoke, and having an SCR2 for short-circuiting terminals with a low impedance in accordance with signals from the sensor 1 and a diode bridge 3 for nonpolarization between the terminals, as shown in FIG. 2B.

The terminal unit EOL need only have an impedance which varies when the polarity of the transmission lines is inverted. An example of the terminal unit EOL is a circuit consisting of a series-connected resistor r and Zener diode Zp as shown in FIG. 3A. Another example is a circuit in which a resistor r' is connected in parallel with a series circuit of a resistor r and a diode p as shown in FIG. 3B. A further example is a circuit in which a resistor r' is connected in parallel with a diode p of the series circuit of a resistor r and a diode p, as shown in FIG. 3C.

In the fire alarm apparatus having the above arrangement, the relay B provided in the fire receiver R is held in a normal operation state by a current flowing through the terminal unit EOL.

When the fire detector D is operated by a fire, the transmission lines l are short-circuited with a low impedance, and the zone relay A is operated to close the normally open contact a, thereby operating the alarm bell BL.

An operation in the case wherein the detector body De is detached from the socket by, e.g., burglary will be described below.

Figure 4A:
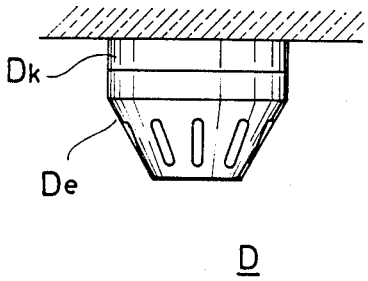
FIGS. 4A and 4B are schematic views respectively showing how a fire detector used in the present invention is installed and an important part of a polarity inverting means provided in the detector.

The fire detector D generally consists of the socket Dk and the detector body De and is installed on a surface of a ceiling, as shown in FIG. 4A.

Figure 4B:
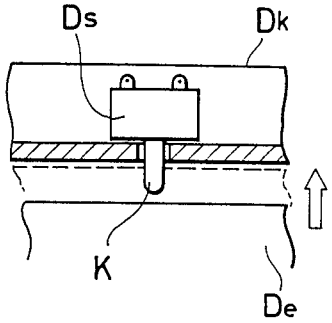

FIG. 4B shows an important part of the fire detector D in which a polarity inverting means of the present invention is provided. In FIG. 4B, the limit switch Ds is provided in the socket Dk. When the detector De is inserted in the socket Dk, a switch lever K of the limit switch Ds is depressed to switch a contact ds of, e.g., the limit switch Ds shown in the circuit diagram of the detector D of FIG. 1, to a position represented by a dotted line. When the contact ds is switched, such as occurs upon removal of the detector body De, the polarity of the transmission lines l, after the detector $D_1$ is inverted and a voltage of the inverted polarity is applied to the terminal unit EOL. As a result, a current flowing to the terminal unit EOL through the diode p thereof is cut to turn off the transistor Tr of the receiver R, and the relay B is reset to close the break contact b, thereby operating the alarm buzzer BZ. When circuits as shown in FIGS. 3A, 3B, and 3C are used as the terminal unit EOL, a current flowing through the terminal unit EOL is reduced when the polarity of the transmission lines is inverted, so that detachment of the detector body, disconnection of the transmission lines, and the operation of the fire detector D can be discriminated in accordance with changes in a current value. In this case, a line current discriminator may be provided in the fire receiver R.

As has been described above, the fire alarm apparatus of the present invention can reliably detect detachment of the fire detector by burglary or the like with a very simple arrangement, and can easily discriminate signals representing the operation of the detector, disconnection of the transmission lines, and detachment of the detector.

Although modifications and changes may be suggested by those skilled in the art it is the intention of the inventor to embody within the patent warranted hereon all changes and modifications as reasonably and properly come within the scope of his contribution to the art.

I claim as my invention:

1. A fire alarm apparatus comprising:

a fire receiver;

a pair of transmission lines extending from said fire receiver and terminating in end terminals;

a plurality of nonpolar fire detectors sequentially connected along said transmission lines before said end terminals;

a terminating unit connected to said end terminals of said transmission lines, said terminating unit including an impedance element including a polar element; and each of said fire detectors including a detachable detector body and a polarity inverting means for inverting the polarity of said transmission lines following a detector upon removal of a detector body from that detector, thereby changing the impedance of said terminating unit and causing said fire receiver to generate an alarm signal.

2. An apparatus as claimed in claim 1, wherein each polarity inverting means comprises:

a socket portion which receives said detector body;

a limit switch disposed in said socket portion and having a switch lever which is actuated by engagement of a detector body with said socket portion; and a pair of diodes connected between said switch lever and one of said transmission lines, said diodes connected to invert the polarity of the transmission lines upon actuation of said lever.

3. An apparatus as claimed in claim 2, wherein said terminating unit comprises a series-connected resistor and Zener diode, whereby current through said terminating unit is blocked and reverse-biased when the polarity of said transmission lines is inverted.

4. An apparatus as claimed in claim 2, wherein said terminating unit comprises:

a series branch including a first resistor and a diode, said series branch connected in parallel with a second resistor, whereby current through said terminating unit is reduced when the polarity of said transmission lines is inverted.

5. An apparatus as claimed in claim 2, wherein said terminating unit comprises:

a series branch including a first resistor and a diode, and a second resistor connected in parallel with said diode, whereby current through said terminating unit is reduced when the polarity of said transmission lines is inverted.

* * * * *